US007331888B2

(12) United States Patent
Jirles

(10) Patent No.: US 7,331,888 B2
(45) Date of Patent: Feb. 19, 2008

(54) FOLDED ARROW FLETCHING

(76) Inventor: Darwin Jirles, 603 N. 10th St., Cambridge, OH (US) 43725

( * ) Notice: Subject to any disclaimer, the term of this patent is extended or adjusted under 35 U.S.C. 154(b) by 0 days.

(21) Appl. No.: 11/165,989

(22) Filed: Jun. 24, 2005

(65) Prior Publication Data

US 2006/0293131 A1 Dec. 28, 2006

(51) Int. Cl.
*F42B 6/06* (2006.01)

(52) U.S. Cl. ..... 473/586

(58) Field of Classification Search ..... 473/578, 473/586; 416/70 A

See application file for complete search history.

(56) References Cited

U.S. PATENT DOCUMENTS

| | | | | |
|---|---|---|---|---|
| 257,058 | A * | 4/1882 | North | 416/70 R |
| 2,830,818 | A | 4/1958 | Otto | |
| 2,887,319 | A | 5/1959 | Lay | |
| 2,976,043 | A | 3/1961 | Meyer | |
| 3,595,579 | A | 7/1971 | Benoit | |
| 3,749,403 | A | 7/1973 | Austin et al. | |
| 3,815,916 | A | 6/1974 | Meszaros | |
| 3,913,917 | A | 10/1975 | Coxon | |
| D243,527 | S | 3/1977 | Schnipke | |
| 4,009,875 | A | 3/1977 | Erlandson | |
| 4,392,654 | A | 7/1983 | Carella | |
| 5,024,448 | A * | 6/1991 | Barrie | 473/586 |
| 5,951,419 | A | 9/1999 | Cameneti | |
| 5,967,161 | A * | 10/1999 | Neal | 135/19.5 |
| 6,203,457 | B1 | 3/2001 | Snook | |
| D449,090 | S | 10/2001 | DelMonte | |
| 6,554,726 | B2 | 4/2003 | Thurber | |
| 6,695,727 | B1 | 2/2004 | Kuhn | |
| 2001/0004614 | A1 | 6/2001 | Thurber | |
| 2003/0045381 | A1 | 3/2003 | Morris et al. | |

* cited by examiner

*Primary Examiner*—John A. Ricci
(74) *Attorney, Agent, or Firm*—Dinsmore & Shohl LLP

(57) ABSTRACT

A fletching for use on an arrow is provided which is formed from a flexible material provided with two or more parallel folds in which each fold opens in the opposite direction. The folds are preferably in the form of accordion folds. A plurality of the fletchings may be mounted on an arrow so as to provide improved arrow flight stability and to create more precision and consistency during arrow flight.

4 Claims, 1 Drawing Sheet

FOLDED ARROW FLETCHING

BACKGROUND OF THE INVENTION

This invention relates to a fletching which may be attached to an arrow used in the field of archery, and more particularly, to an arrow fletching having a folded configuration which stabilizes the flight of the arrow.

Arrows conventionally include the use of fletchings which are mounted on the rear end of the arrow shaft to provide flight stability. Typically, three to four fletchings are mounted circumferentially around the rear end of the arrow shaft. The fletchings are typically either glued in place separately by hand or with the aid of a fletching jig.

In the past, fletchings were typically made of feathers. In more recent years, alternative flexible materials such as plastics and vinyls have been used as a replacement for feathers as they are mechanically tougher than feathers and they are not affected by environmental conditions such as temperature and precipitation. Such materials are typically molded into the shape of the fletching and then attached to the arrow shaft.

However, one disadvantage of plastic materials is that they are not always sufficiently lightweight, flexible, or resilient, which can adversely affect the flight of the arrow. For example, if the plastic fletching comes into contact with a portion of the bow riser or cable, the arrow flight can become distorted.

Accordingly, there is still a need in the art for an arrow fletching which is lightweight, sufficiently flexible so as to provide stable arrow flight, and which remains unaffected by changes in environmental conditions.

SUMMARY OF THE INVENTION

The present invention meets that need by providing a fletching which is provided in a folded configuration to provide improved flight stability. The fletching is formed of a lightweight, flexible material, and is resistant to environmental conditions such as precipitation.

According to one aspect of the present invention, a fletching for use on an arrow is provided comprising a unitary sheet of flexible material which includes two or more parallel folds in which each fold opens in the opposite direction. The sheet has first and second ends, where the folds at the first end are substantially compressed and the folds at the second end are substantially open. Preferably, the folds are in the form of accordion folds. The flexible material preferably comprises a polymeric film.

In another embodiment of the invention, an arrow is provided comprising, in combination, a substantially cylindrical shaft having first and second ends, and a plurality of fletchings mounted on the second end of the shaft; wherein each of the fletchings comprises a unitary sheet of flexible material which includes two or more parallel folds in which each fold opens in the opposite direction. The sheet has first and second ends such that the folds at the first end are substantially compressed and the folds at the second end are substantially open as described above.

The arrow including the fletchings of the present invention exhibits good aerodynamics with less distortion of arrow flight, resulting in a more stable flight pattern for the arrow. While not wishing to be bound by any specific theory of operation, it is believed that during flight, the air flow over the fletchings will cause the folds to flare outward, creating a larger surface area and helping to stabilize arrow flight.

Accordingly, it is a feature of embodiments of the present invention to provide a fletching for use on an arrow which provides a stable flight for the arrow. These, and other features and advantages of embodiments of the present invention will become apparent from the following detailed description, the accompanying drawings, and the appended claims.

DETAILED DESCRIPTION OF THE PREFERRED EMBODIMENTS

I have found that the fletching of the present invention which includes a folded configuration results in improved launching of an arrow due to less distortion, i.e., the arrow may be shot from a bow with less friction against the bow riser or sight window. In addition, the aerodynamic properties of the folds of the fletching are believed to stabilize arrow flight and may increase arrow speed.

Figure 1:
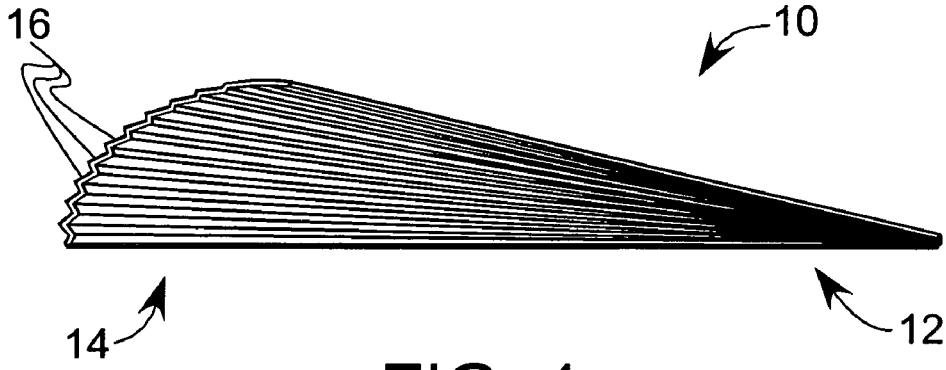
FIG. 1 is a perspective view of the fletching of the present invention.

Referring now to FIG. 1, the fletching 10 of the present invention is shown including a first end 12 and a second end 14. As shown, the fletching includes a plurality of folds 16 arranged in accordion fashion, i.e., each of the folds opens in an opposite direction. The fletching is preferably formed by a molding process. Alternatively, the fletching may be formed from a flat sheet of film using a scoring tool, followed by folding the fletching in the desired accordion configuration. The compressed end of the fletching is then heat sealed or glued to maintain its shape.

As shown, the folds at the first end are substantially compressed and the folds at the second end are substantially open. This configuration provides a desired "drag" surface which stabilizes the arrow during flight. It should be appreciated that the folds may vary in size and length. Preferably, the folds are from about 4 to 5 inches in length.

As can also be seen from FIG. 1, the second end 14 of the fletching is tapered so as to provide a curved shape.

The material used to form the fletching should be uniform in size and thickness, and must be lightweight. The material should exhibit excellent recovery characteristics, i.e., it should be able to return quickly to an open fan configuration after being compressed. In addition, the material should be durable and resistant to environmental conditions such as humidity. The fletching is preferably comprised of a flexible material such as a polymeric film. However, it should be appreciated that any suitable flexible material may be used as long as it exhibits the above characteristics.

Figure 2:
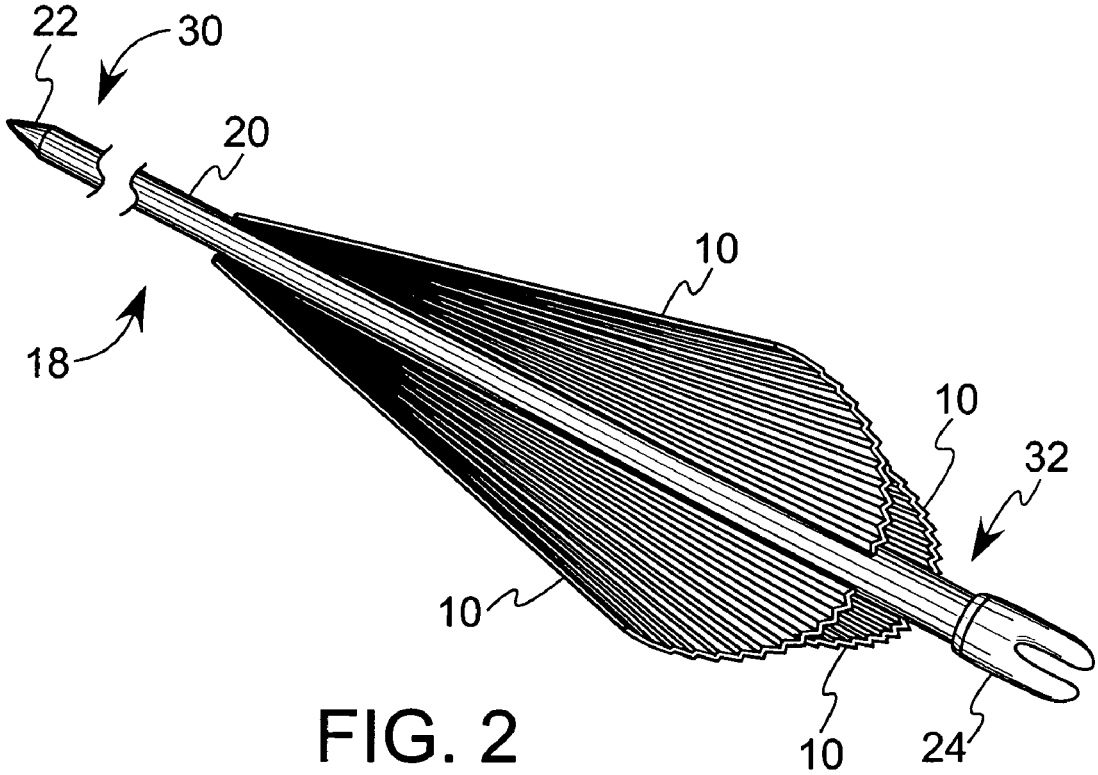
FIG. 2 is a perspective view of an arrow having a plurality of fletchings mounted thereon in accordance with an embodiment of the present invention.

FIG. 2 illustrates a plurality of fletchings 10 mounted on an arrow 18. The arrow includes a substantially cylindrical, elongated shaft 20 including first and second ends 30 and 32. The shaft may comprise any of a number of conventional materials such as wood, aluminum, or fiber-reinforced glass or carbon. As shown, the front end of the shaft 20 terminates at a point 22, and a nock 24 is fixed to the rear end of the shaft.

The fletchings 10 are mounted on the second end of the shaft 32. In the embodiment shown, four fletchings are mounted on the arrow. However, it should be appreciated that the number of fletchings mounted may vary according to the size of the arrow and the desired aerodynamics. The fletchings may be mounted by a number of conventional techniques known in the art.

In the foregoing specification, the invention has been described with reference to specific embodiments. However, one of ordinary skill in the art appreciates that various modifications and changes can be made without departing from the skill of the present invention as set forth in the claims below. Accordingly, the specification and figures are to be regarded in an illustrative rather than a restrictive sense, and all such modifications are intended to be included within the scope of the present invention.

What is claimed is:

1. An arrow comprising, in combination:

a substantially cylindrical shaft having first and second ends;

a plurality of fletchings mounted on the second end of said shaft; wherein each of said fletchings initially comprises a unitary sheet of flexible, compressible material which includes two or more parallel folds in which each fold opens in the opposite direction; said sheet having first and second ends; wherein said first end of said sheet has been compressed along said folds such that the folds at said first end are substantially compressed and the folds at said second end are substantially open.

2. The arrow of claim 1 wherein said folds are in the form of accordion folds.

3. The arrow of claim 1 wherein said flexible material comprises a polymeric film.

4. The arrow of claim 1 wherein each of said fletchings are formed from a flat sheet of said flexible material which is folded in parallel folds and compressed and sealed at one end.

* * * * *